US010786844B2

(12) United States Patent
Oakley

(10) Patent No.: US 10,786,844 B2
(45) Date of Patent: Sep. 29, 2020

(54) BALANCED PANEL PUNCH DRIVE SYSTEM

(71) Applicant: Myron Milo Oakley, Winnebago, IL (US)

(72) Inventor: Myron Milo Oakley, Winnebago, IL (US)

( * ) Notice: Subject to any disclaimer, the term of this patent is extended or adjusted under 35 U.S.C. 154(b) by 230 days.

(21) Appl. No.: 15/630,905

(22) Filed: Jun. 22, 2017

(65) Prior Publication Data

US 2017/0368589 A1 Dec. 28, 2017

Related U.S. Application Data

(60) Provisional application No. 62/353,363, filed on Jun. 22, 2016.

(51) Int. Cl.
*B21D 24/14* (2006.01)
*B30B 15/04* (2006.01)
(Continued)

(52) U.S. Cl.
CPC ..... *B21D 24/14* (2013.01); *B21D 28/002* (2013.01); *B30B 15/04* (2013.01); *B30B 15/067* (2013.01);
(Continued)

(58) Field of Classification Search
CPC ..... B30B 1/34; B30B 15/16; B30B 15/18; B30B 15/183; B30B 15/24; B30B 15/065;
(Continued)

(56) References Cited

U.S. PATENT DOCUMENTS 2,986,057 A * 5/1961 Novak ..... B21D 28/002 60/426
3,257,810 A * 6/1966 Hanni ..... B30B 15/24 60/545
(Continued)

FOREIGN PATENT DOCUMENTS

FR 1376874 A * 10/1964 ..... B30B 15/24
GB 683840 A * 12/1952 ..... F16B 3/00
WO WO-2004101263 A1 * 11/2004 ..... B30B 15/161

OTHER PUBLICATIONS

Machine Translation of FR-1376874-A from Espacenet, Chapuis, Patent Publication Year 1964, Total pp. 4 (Year: 2019).*

*Primary Examiner* — Teresa M Ekiert
*Assistant Examiner* — Sarkis A Aktavoukian
(74) *Attorney, Agent, or Firm* — Kilyk & Bowersox, P.L.L.C.

(57) ABSTRACT

A balanced panel punch drive system. The system includes a main hydraulic drive including an outer casing forming an internal housing and a main piston slidably disposed within the internal housing. A main fluid chamber, a first output chamber and a second output chamber are formed within the internal housing. A pump is fluidly connected to the main fluid chamber by an input line. A first die hydraulic cylinder and a second die hydraulic cylinder each have an outer casing forming an internal housing and a die piston slidably disposed within the internal housing. An opening is formed through an end of the outer casing sized to receive a distal end of the die piston therethrough. A first output line fluidly connects the first output chamber to the first die hydraulic cylinder and a second output line fluidly connects the second output chamber to the second die hydraulic cylinder.

9 Claims, 4 Drawing Sheets

(51) Int. Cl.

| | |
|---|---|
| ***B21D 28/00*** | (2006.01) |
| ***B30B 15/24*** | (2006.01) |
| ***B30B 15/06*** | (2006.01) |
| ***B21D 22/10*** | (2006.01) |
| ***B21D 26/02*** | (2011.01) |

(52) U.S. Cl.
CPC ..... *B30B 15/24* (2013.01); *B21D 22/10* (2013.01); *B21D 26/02* (2013.01)

(58) Field of Classification Search
CPC ... B30B 15/067; B21J 7/28; B21J 9/12; F15B 2211/7107; F15B 2211/782; F15B 3/00; B21D 24/14; B21D 28/002
USPC ..... 72/57, 453.02, 453.04, 453.06, 453.07; 100/269.1, 269.03; 83/515, 639.1–639.5, 83/684, 685, 686, 689, 690; 60/484
See application file for complete search history.

(56) References Cited

U.S. PATENT DOCUMENTS 3,407,601 A * 10/1968 Beck ..... F15B 3/00 417/226
3,425,219 A * 2/1969 Morris ..... B23D 15/14 30/360
3,594,904 A * 7/1971 Wright ..... B21D 28/34 30/30
3,945,206 A * 3/1976 Krause ..... B21J 7/14 60/374
4,495,699 A * 1/1985 Oakes ..... B21D 28/343 30/360
5,036,588 A * 8/1991 Cherry ..... B23D 15/145 30/180
5,271,262 A * 12/1993 Moritani ..... B21K 1/761 100/269.07
5,640,877 A * 6/1997 Danly, Sr. ..... B21D 28/24 100/269.06

* cited by examiner

BALANCED PANEL PUNCH DRIVE SYSTEM

CROSS-REFERENCE TO RELATED APPLICATION

This application claims the benefit of priority of U.S. provisional application No. 62/353,363, filed Jun. 22, 2016, the contents of which are herein incorporated by reference.

BACKGROUND OF THE INVENTION

The present invention relates to a hydraulic punch drive system and, more particularly, to a balanced hydraulic punch drive system.

In hydraulic presses slides are provided which reciprocate toward and away from the press bed on which there is a die and a work piece to be stamped. The press is provided with a main hydraulic system which provides closing cylinders at each end of the press with hydraulic fluid under pressure for moving the slide toward the bed. Pull-back cylinders are also provided to which hydraulic fluid under pressure is fed for the purpose-of moving the slide away from the bed after the drawing operation has been performed.

In hydraulic presses particularly, and especially the larger ones, there is always a tendency for one end or the other of the slide to move faster or slower than the other end especially during the working stroke. Furthermore, if this is permitted to occur, there is a possibility that one part of the slide may press against a work piece when another part does not. There will, therefore, be a tendency for that part of the slide which is out of contact with the work piece to continue to move, whereupon the slide becomes out of alignment and exerts undue pressures against the sides of the press frame. The present invention is designed to overcome these difficulties and to synchronize the movements of the ends of the slide so that they will be maintained at constant relative levels throughout the entire stroke of the slide.

As can be seen, there is a need for a hydraulic metal working press, suitable mechanism for synchronizing the reciprocating movement of a slide therein and maintaining both ends of the slide at constant relative levels throughout the entire stroke thereof.

SUMMARY OF THE INVENTION

In one aspect of the present invention, a balanced panel punch drive system comprises: a main hydraulic drive comprising an outer casing forming an internal housing and a main piston slidably disposed along a longitudinal axis within the internal housing, wherein a main fluid chamber, a first output chamber and a second output chamber are formed within the internal housing; a pump; an input line fluidly connecting the pump to the main fluid chamber; a first die hydraulic cylinder and a second die hydraulic cylinder each comprising an outer casing forming an internal housing and a die piston slidably disposed along a longitudinal axis within the internal housing, wherein an opening is formed through an end of the outer casing sized to receive a distal end of the die piston therethrough; a first output line fluidly connecting the first output chamber to a main die chamber of the internal housing of the first die hydraulic cylinder; and a second output line fluidly connecting the second output chamber to a main die chamber of the internal housing of the second die hydraulic cylinder.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
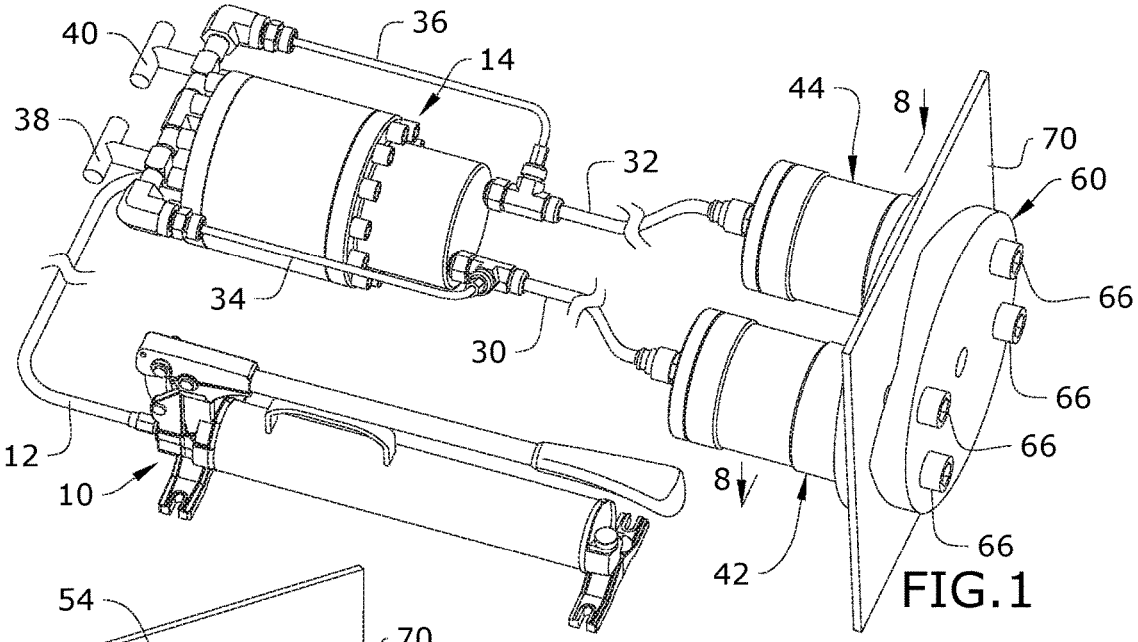
FIG. 1 is a perspective view of an embodiment of the present invention.
Figure 2:
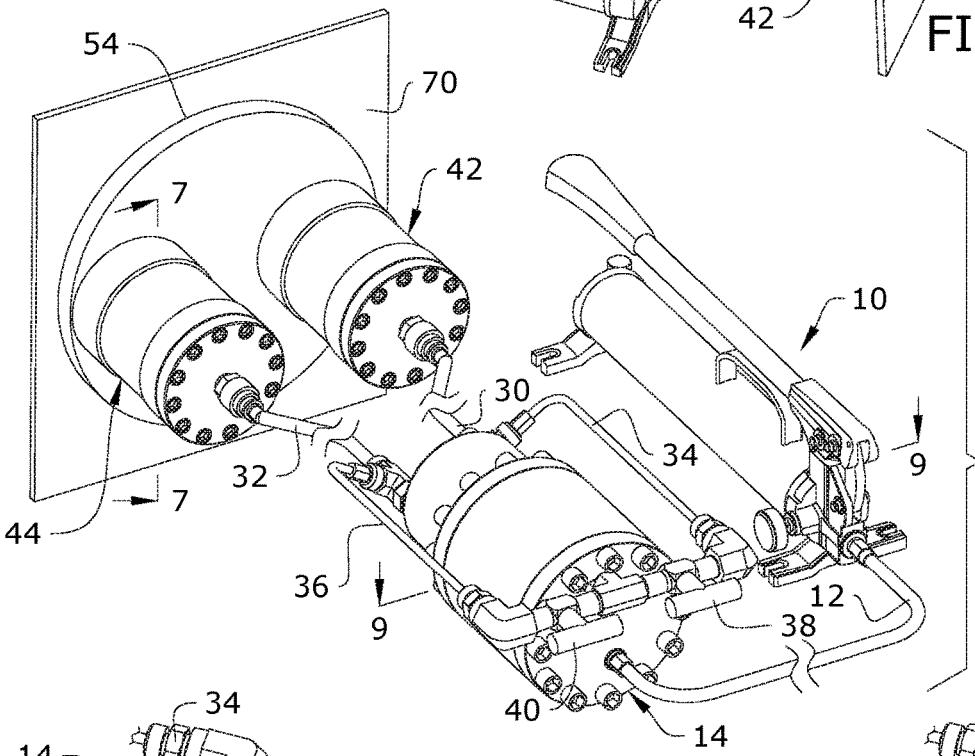
FIG. 2 is a reverse perspective view of an embodiment of the present invention.
Figure 3:
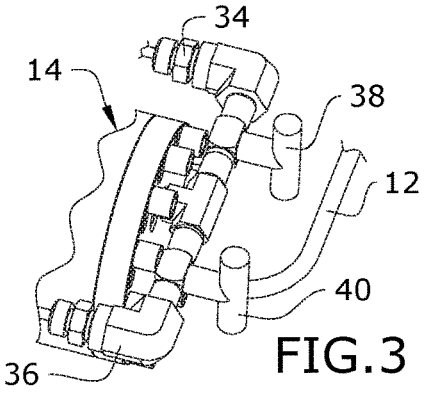
FIG. 3 is a perspective detail view of an embodiment of the present invention illustrating valves in an initial position.
Figure 4:
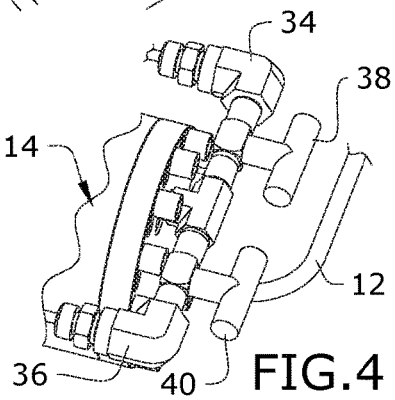
FIG. 4 is a perspective detail view of an embodiment of the present invention illustrating valves in a secondary position.
Figure 5:
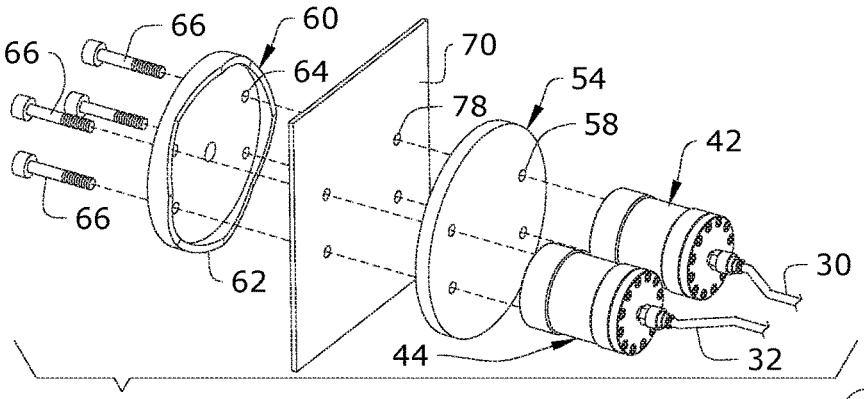
FIG. 5 is an exploded detail view of an embodiment of the present invention.
Figure 6:
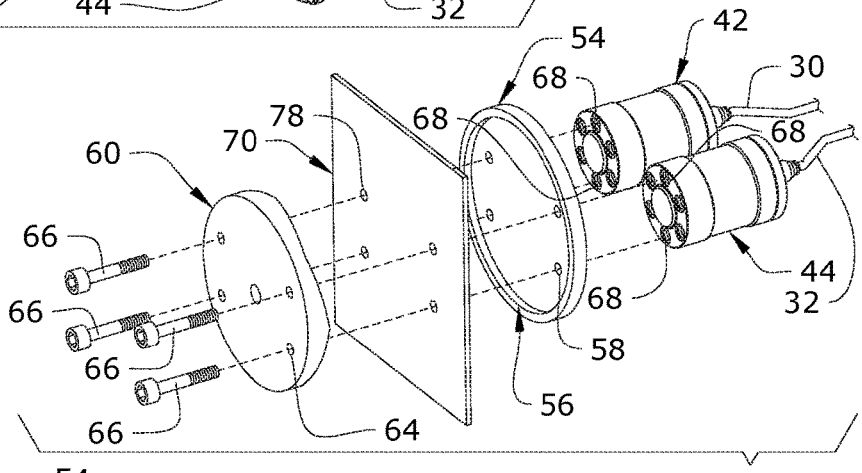
FIG. 6 is a reverse exploded detail view of an embodiment of the present invention.
Figure 7:
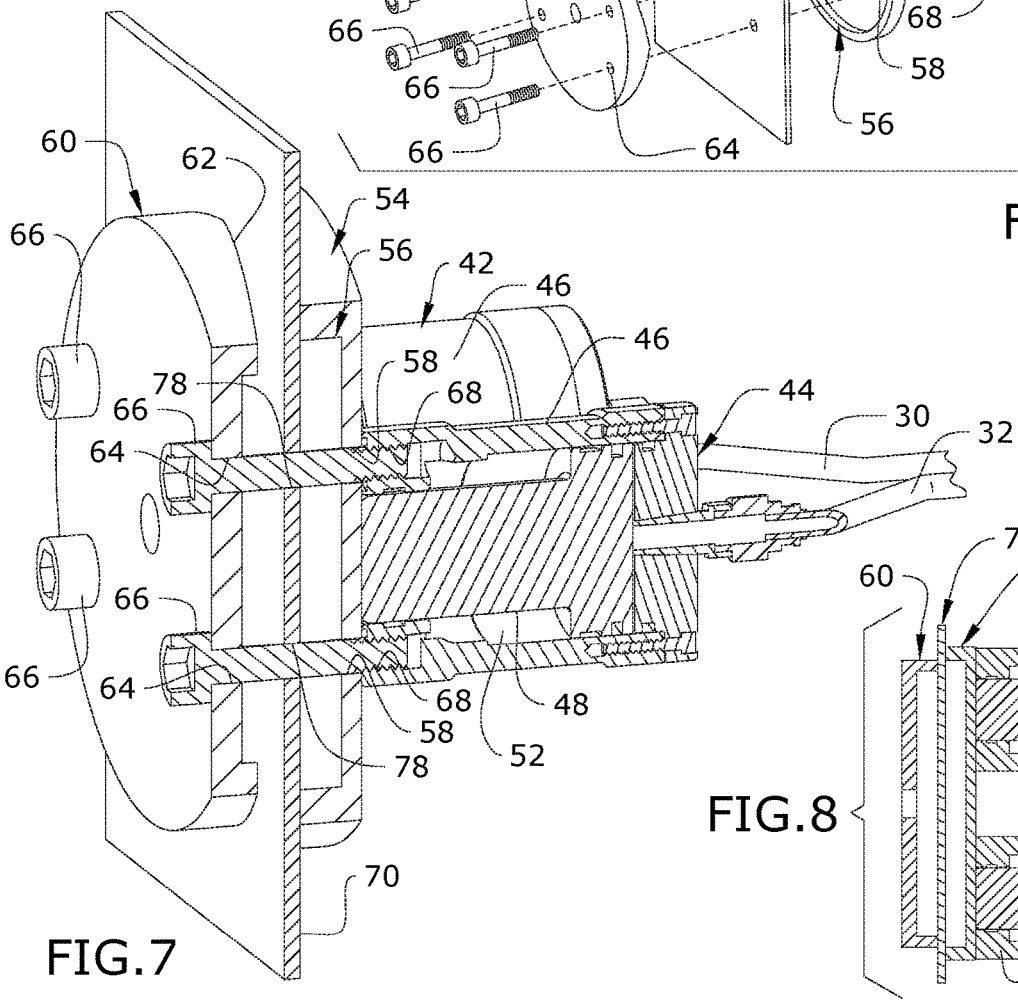
FIG. 7 is a cutaway detail perspective view taken along line 7-7 in FIG. 2.
Figure 8:
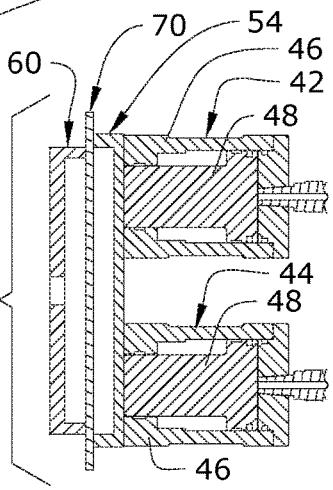
FIG. 8 is a section detail top view of the present invention taken along line 8-8 in FIG. 1.
Figure 9:
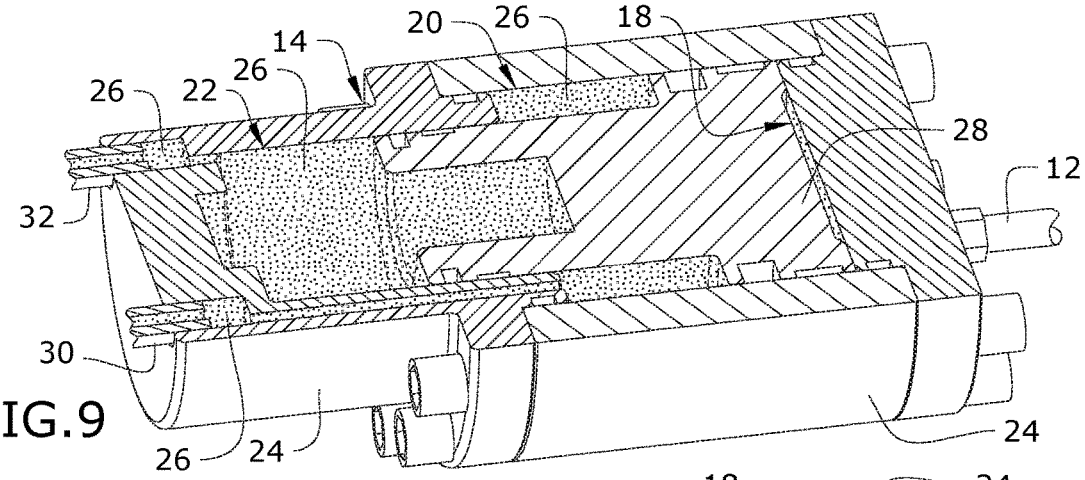
FIG. 9 is a section detail cutaway view of the present invention taken along line 9-9 in FIG. 2 in an initial configuration.
Figure 10:
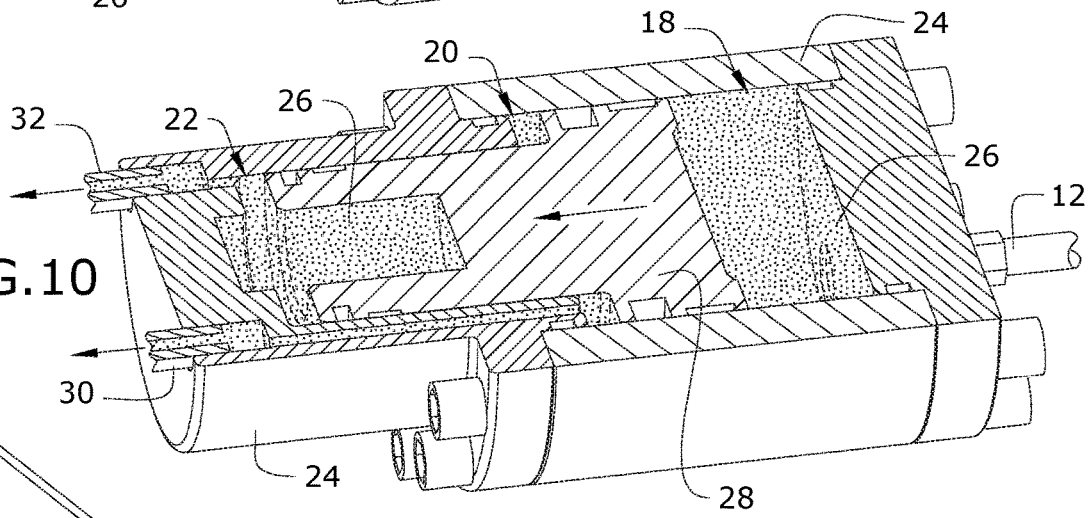
FIG. 10 is a section detail cutaway view of the present invention in a secondary configuration.
Figure 11:
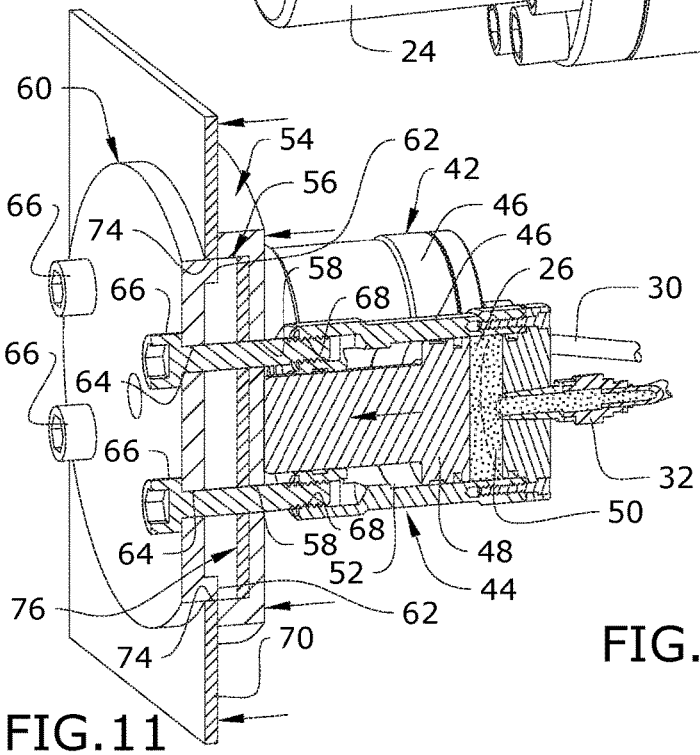
FIG. 11 is a cutaway detail perspective view of an embodiment of the present invention in use.
Figure 12:
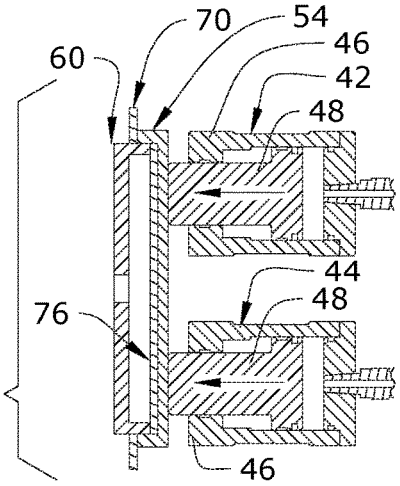
FIG. 12 is a section detail top view of an embodiment of the present invention illustrating dual resultant shear action.
Figure 13:
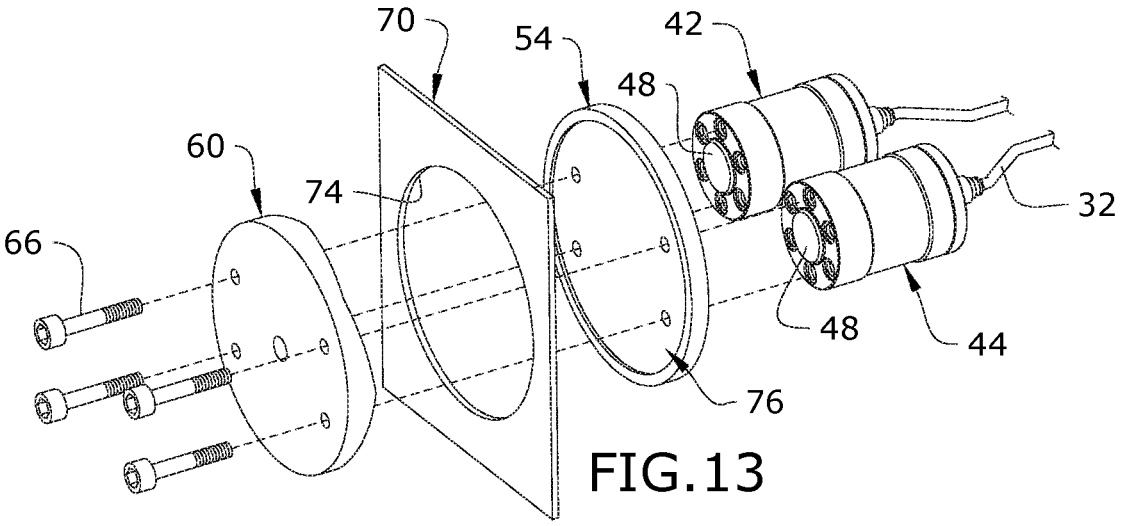
FIG. 13 is an exploded detail view of an embodiment of the present invention.
Figure 14:
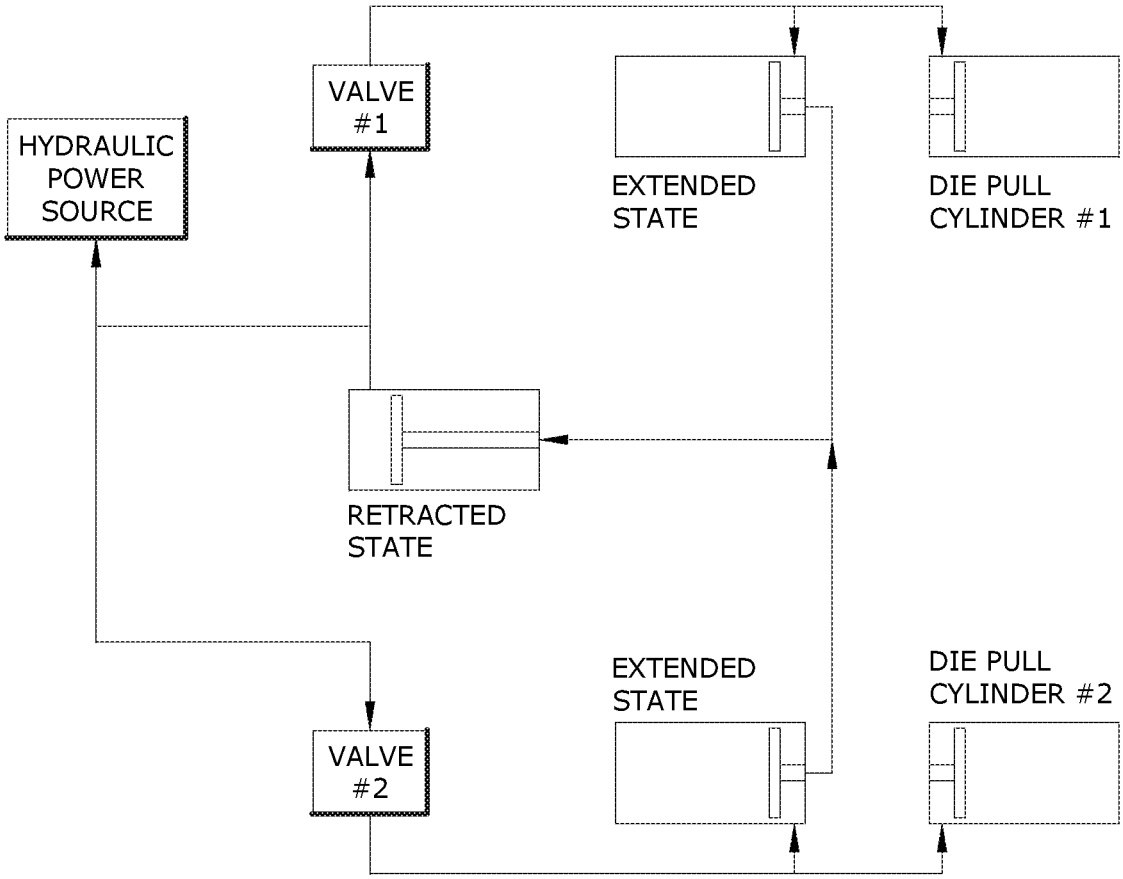
FIG. 14 is a schematic view of an embodiment of the present invention.

Referring to FIGS. 1 through 14, the present invention includes a balanced panel punch drive system. The system includes a main hydraulic drive 14 including an outer casing 24 forming an internal housing and a main piston 28 slidably disposed along a longitudinal axis within the internal housing. A main fluid chamber 18, a first output chamber 20 and a second output chamber 22 are formed within the internal housing. A pump 10 is fluidly connected to the main fluid chamber 18 by an input line 12. The system further includes a first die hydraulic cylinder 42 and a second die hydraulic cylinder 44 each having an outer casing 46 forming an internal housing and a die piston 48 slidably disposed along a longitudinal axis within the internal housing. An opening is formed through an end of the outer casing 46 sized to receive a distal end of the die piston 48 therethrough. A first output line 30 fluidly connects the first output chamber 20 to a main die chamber 50 of the internal housing of the first die hydraulic cylinder 42 and a second output line 32 fluidly connects the second output chamber 22 to a main die chamber 50 of the internal housing of the second die hydraulic cylinder 44.

The pump 10 of the present invention may be a hydraulic pump. The hydraulic pump may include a manual pump that is hand cranked or an automatic pump that is driven by a motor.

The internal housing of the main hydraulic drive 14 includes a wide portion and a narrow portion. The main piston 28 also includes a wide portion and a narrow portion. The wide portion of the main piston 28 is slidably disposed within the wide portion of the internal housing and the narrow portion of the main piston 28 is slidably disposed within the narrow portion of the internal housing. The wide portion of the main piston 28 may be biased by a spring against the internal housing. The main fluid chamber 18 is formed within the wide portion of the internal housing between an end of the wide portion of the main piston 28 and an end of the internal housing. The first output chamber 20 is formed within the wide portion of the internal housing in between the wide portion of the main piston 28 and the narrow portion of the internal housing. The second output chamber 22 is formed within the narrow portion of the internal housing in between the narrow portion of the main piston 28 and an opposing end of the internal housing. The first output chamber 20 and the second output chamber 22 have an equal volume and thereby deliver an equal amount of fluid 26 to the first and second die hydraulic cylinders 42, 44.

The internal housing of each of the first and second die hydraulic cylinders 42, 44 includes a wide portion and a narrow portion. Each of the die pistons 48 includes a wide portion and a narrow portion. The wide portions of the die pistons 48 is slidably disposed within the wide portions of the internal housings and the narrow portion of the die pistons 48 is slidably disposed within the narrow portions of the internal housings. The wide portions of the die pistons 48 may be spring biased against the internal housings. The main die chambers 50 of the first and second die hydraulic cylinders 42, 44 are formed between an end of the internal housing opposing the openings and the wide portions of the die pistons 48. A secondary chamber 52 is formed in between the wide portions of the die pistons 48 and the openings. The wide portions of the die pistons 48 abut against the narrow portions of the internal housings when the die pistons 48 are extended from the openings.

The present invention may further include a first valve line 34 fluidly connecting at least one of the main fluid chamber 18 and the pump 10 to the main die chamber 50 of the first die hydraulic cylinder 42 and a second valve line 36 fluidly connecting at least one of the main fluid chamber 18 and the pump 10 to the main die chamber 50 of the second die hydraulic cylinder 44. As illustrated in the Figures, the valve lines 34, 36 run from the main fluid chamber 18 to the output lines 30, 32. A first valve 38 is operable to control a flow through the first valve line 34 and a second valve 40 is operable to control a flow through the second valve line 36.

Each of the first die hydraulic cylinder 42 and the second die hydraulic cylinder 44 includes at least one threaded opening 68 formed at the end of the outer casing 46. The at least one threaded opening 68 may include a plurality of threaded openings 68 equidistant to one another. The present invention may further utilize threaded bolts 66 sized to fit through aligned openings 58, 64 of a die set 54, 60 and mechanically fasten to the threaded openings 68. The die set 54, 60 includes a die backing plate 54 and a die cutter plate 60. The die backing plate 54 includes openings 58 and a die plate inset 56. The die cutter plate 60 includes openings 64 and a cutting rim 62.

In use, the threaded bolts 66 are placed through the openings of the die cutter plate 60, through the openings 78 of a target plate 70, through the openings of the die backing plate 54 and are mechanically fastened to the threaded openings 68 of the first and second die hydraulic cylinders 42, 44. The first and second valves 38, 40 are opened, allowing fluid 26 to run into the main die chambers 50 pushing the die pistons 48 so that the die pistons 48 are evenly pressed against the die backing plate 54 at around 300 psi. The first and second valves 38, 40 are then closed. The pump 10 is then activated to pump the fluid 26 into the main fluid chamber 18 of the outer casing 24 at a higher pressure of around 1000 psi, pushing the main piston 28 forward causing the main piston 28 to push an equal amount of fluid 26 from the first output chamber 20 into the main die chamber 50 of the first die hydraulic cylinder 42 and from the second output chamber 22 into the main die chamber 50 of the second die hydraulic 42, thereby pushing the die pistons 48 of the first and second die hydraulic cylinders 42, 44 against the die backing plate 54 at an even pressure. Due to the increased pressure, the cutting rim 62 cuts out a cut plate shear shape 74 and a shear plate 76 from the target plate 70.

It should be understood, of course, that the foregoing relates to exemplary embodiments of the invention and that modifications may be made without departing from the spirit and scope of the invention as set forth in the following claims.

What is claimed is:

1. A balanced panel punch drive system comprising:

a main hydraulic drive comprising an outer casing forming an internal housing and a main piston slidably disposed along a longitudinal axis within the internal housing, wherein a main fluid chamber, a first output chamber and a second output chamber are formed within the internal housing;

an input line configured to fluidly connect a pump to the main fluid chamber;

a first die hydraulic cylinder and a second die hydraulic cylinder each comprising an outer casing forming an internal housing and a die piston slidably disposed along a longitudinal axis within the internal housing, wherein an opening is formed through an end of the outer casing sized to receive a distal end of the die piston therethrough;

a first output line fluidly connecting the first output chamber to a main die chamber of the internal housing of the first die hydraulic cylinder;

a second output line fluidly connecting the second output chamber to a main die chamber of the internal housing of the second die hydraulic cylinder;

a first valve line fluidly connecting the main fluid chamber of the main hydraulic drive to the main die chamber of the first die hydraulic cylinder; and a second valve line fluidly connecting the main fluid chamber of the main hydraulic drive to the main die chamber of the second die hydraulic cylinder, wherein when the first valve line and the second valve line are open, fluid is pumped from the pump to the main fluid chamber, from the main fluid chamber to the first valve line and the second valve line, and into the main die chambers of the first die hydraulic cylinder and second die hydraulic cylinder, and when the first valve line and the second valve line are closed, the fluid is pumped from the pump to the main fluid chamber so that the main piston urges fluid from the first output chamber into the main die chamber of the first die hydraulic cylinder and urges fluid from the second output chamber into the main die chamber of the second die hydraulic cylinder.

2. The balanced panel punch drive system of claim 1, wherein the first output chamber and the second output chamber have an equal volume.

3. The balance panel punch drive system of claim 1, wherein the main piston is pushed forward causing the main piston to push an equal amount of fluid from the first output chamber into the main die chamber of the first die hydraulic cylinder and from the second output chamber into the main die chamber of the second die hydraulic, thereby pushing the die pistons of the first and second die hydraulic cylinders beyond the openings at a substantially equal distance.

4. The balanced panel punch drive system of claim 1, wherein the internal housing of the main hydraulic drive comprises a wide portion and a narrow portion, wherein the main piston comprises a wide portion and a narrow portion, wherein the wide portion of the main piston is slidably disposed within the wide portion of the internal housing and the narrow portion of the main piston is slidably disposed within the narrow portion of the internal housing.

5. The balanced panel punch drive system of claim 4, wherein the main fluid chamber is formed within the wide portion of the internal housing between an end of the wide portion of the main piston and an end of the internal housing, the first output chamber is formed within the wide portion of the internal housing in between the wide portion of the main piston and the narrow portion of the internal housing and the second output chamber is formed within the narrow portion of the internal housing in between the narrow portion of the main piston and an opposing end of the internal housing.

6. The balanced panel punch drive system of claim 1, wherein each of the first die hydraulic cylinder and the second die hydraulic cylinder comprises at least one threaded opening formed at the end of the outer casing.

7. The balanced panel punch drive system of claim 6, wherein the at least one threaded opening is plurality of threaded openings equidistant to one another.

8. The balanced panel punch drive system of claim 6, further comprising threaded bolts sized to fit through aligned openings of a die set and mechanically fasten to the threaded openings.

9. The balanced panel punch drive system of claim 1, wherein the internal housing of each of the first and second die hydraulic cylinders comprises a wide portion and a narrow portion, wherein each of the die pistons comprises a wide portion and a narrow portion, wherein the wide portions of the die pistons is slidably disposed within the wide portions of the internal housings and the narrow portion of the die pistons is slidably disposed within the narrow portions of the internal housings, wherein the main die chambers of the first and second die hydraulic cylinders are formed between an end of the internal housing opposing the openings and the wide portions of the die pistons, wherein the wide portions of the die pistons abut against the narrow portions of the internal housings when the die pistons are extended from the openings.

* * * * *